US005915587A

United States Patent [19]

Kramer

[11] Patent Number: 5,915,587

[45] **Date of Patent: *Jun. 29, 1999**

[54] MICROSEAMED METALLIC CAN

[76] Inventor: Antonio Henrique Kramer, R. Zuferey, 1.439, Jundial, San Paulo, Brazil

[ * ] Notice: This patent is subject to a terminal disclaimer.

[21] Appl. No.: 08/785,779

[22] Filed: Jan. 21, 1997

Related U.S. Application Data

[60] Continuation-in-part of application No. 08/180,647, Jan. 13, 1994, Pat. No. 5,595,322, which is a division of application No. 08/045,436, Apr. 8, 1993, Pat. No. 5,320,468, which is a continuation-in-part of application No. 07/729,331, Jul. 12, 1991, abandoned.

[30] Foreign Application Priority Data

Jul. 13, 1990 [BR] Brazil ..... 9003371

[51] Int. Cl.[6] ..... B65D 8/20

[52] U.S. Cl. ..... 220/619

[58] Field of Search ..... 220/906, 619, 220/620, 309, 615, 610

[56] References Cited

U.S. PATENT DOCUMENTS

| | | | |
|---|---|---|---|
| 3,281,024 | 10/1966 | Henchert et al. | 220/906 |
| 4,037,550 | 7/1977 | Zofko | 220/619 |
| 4,467,933 | 8/1984 | Wilkinson et al. . | |
| 4,538,758 | 9/1985 | Griffith . | |
| 5,078,564 | 1/1992 | Zago . | |
| 5,573,133 | 11/1996 | Park | 220/906 |
| 5,582,319 | 12/1996 | Heyes et al. . | |
| 5,595,322 | 1/1997 | Kramer | 220/619 |

FOREIGN PATENT DOCUMENTS

| | | | |
|---|---|---|---|
| 385100 | 2/1965 | Switzerland | 220/619 |

*Primary Examiner*—Stephen J. Castellano
*Attorney, Agent, or Firm*—Londa and Traub LLP

[57] ABSTRACT

The present invention refers to a can having a seam formed by a seaming process, through which it is possible to produce cans by seaming (fixing) tops and ends to bodies of cans by a microseaming process, forming a microseam. This microseamed can is made by using materials with 0.16 mm thickness or less, with a high hardness DR8 or DR9, or aluminum or other materials, for making tops, ends and bodies. As a result of the microseamed can a significant reduction of dimensions has been obtained on the cover and body hooks and in the length of the seam, without changing volumetric capacity of the can.

30 Claims, 8 Drawing Sheets

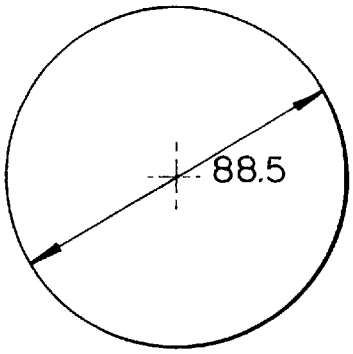
FIG. 5 PRIOR ART
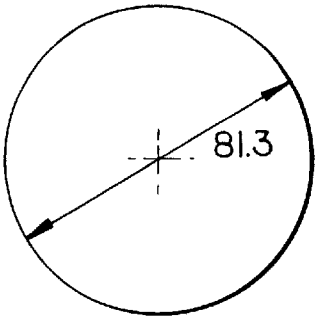
FIG. 6
FIG. 7 PRIOR ART
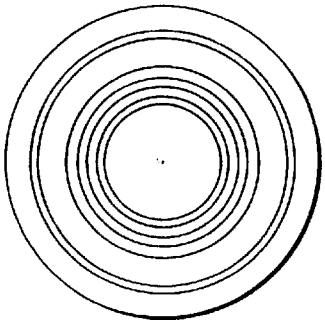
FIG. 8
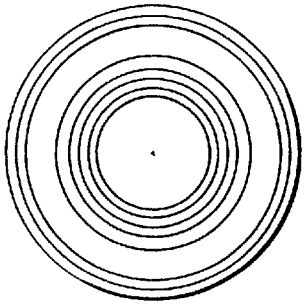
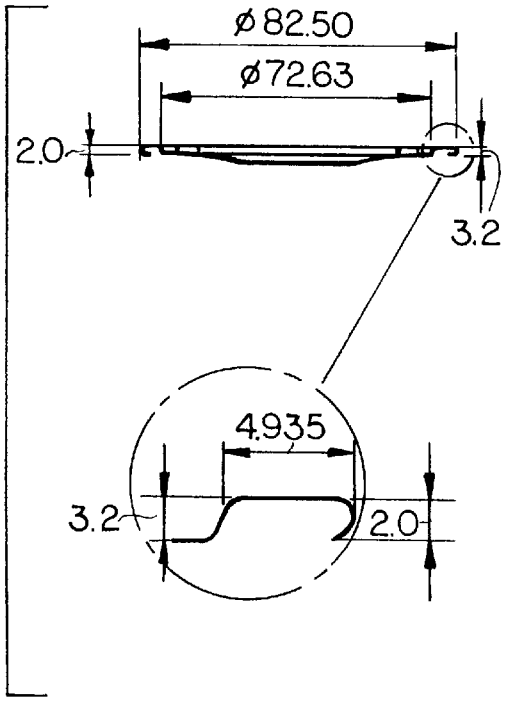
FIG. 9
PRIOR ART
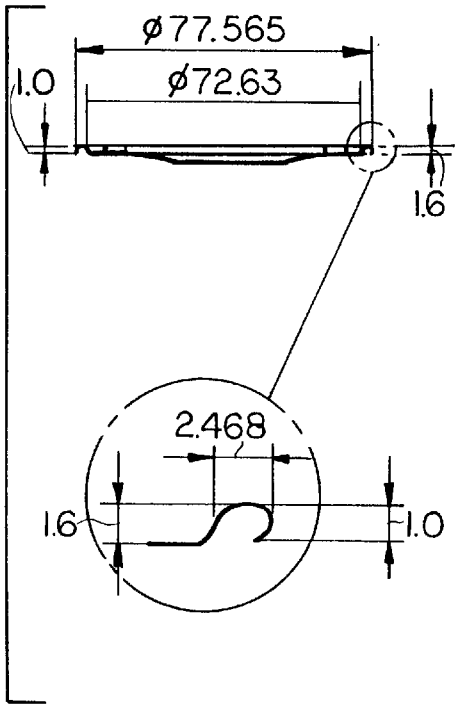
FIG. 10

MICROSEAMED METALLIC CAN

The present application is a continuation-in-part application of allowed U.S. patent application Ser. No. 08/180,647 filed Jan. 13, 1994, now U.S. Pat. No. 5,595,322 issued on Jan. 21, 1997, which was a divisional of U.S. patent application Ser. No. 08/045,436 filed on Apr. 8, 1993, now U.S. Pat. No. 5,320,468, which is a continuation-in-part of U.S. patent application Ser. No. 07/729,331 filed on Jul. 12, 1991, now abandoned.

BACKGROUND

The present invention is directed to a metallic can having a microseam formed by the microseaming process of U.S. Pat. No. 5,320,468, and refers particularly to the seams formed with the ends of the can, either the tops or the bottoms, by which, due to a substantial reduction of the dimensions of the hooks and other fixing folds, a considerable and advantageous reduction of the diameters of the cut-outs of the material employed for the manufacture of the top and end of a can is obtained. In addition, a significant reduction of the height of the can body may be obtained, where desirable, and this without change of the holding capacity of the can. This is a process from which substantial savings of metal sheet results, both in quantity as well as by enabling the employment of thinner and harder sheet metal, for example, of 0.16 mm thickness and DR8 temper, in the case where tinplate (steel coated with tin) is used, the price of which is 21.2 to 28.3% lower than that of the conventionally used metal sheet, i.e. of 0.22 to 0.24 mm thickness and the normal temper required. In addition, the cans having a microseam of the present invention may be manufactured using any metal appropriate to can making, such as aluminum.

As is known to those with knowledge of the matter, the currently used conventional cans designed to serve as packing for the most diverse products, particularly for food products and the so-called sanitary cans, are normally obtained by using tinplate of 0.22 to 0.24 mm thickness with the normal temper required for the top and the end of a can, features which would also allow the employment of this metal sheet for micro-seaming, however, without the advantages of large savings of 21.2 to 28.3% obtained as a result of the use of a metal sheet of 0.16 mm thickness and DR8 temper, as outlined by the microseaming process.

The subject microseamed metallic can provides substantial savings, both by the substantial reduction of diameters of the cut-outs for the top and the end of a can, and this as a consequence of the reduction of the dimensions of the hooks and other fixing folds, as well as by the reduction of height provided to the can body without changing its holding capacity. These savings become more significant due to the employment of a thinner and harder metal sheet, for example, of 0.16 mm thickness with DR8 temper tinplate, as compared to the conventionally used metal sheet of 0.22 to 0.24 mm thickness and the normal temper required for the top and the end of a can.

This new metallic can may be made with an electrically welded (3 piece cans) or deep drawn body (2 piece cans), i.e. those bodies with no lap or two thicknesses where the joint is obtained by folds soldered with tin or lead or thermoplasts, a condition which renders this new can infeasible.

The new metallic can and its manufacturing process as stated before is represented in the attached drawings which show, for comparison purposes, both the cut-out discs of the top and end, as well as the fixed parts and the can body, with their respective dimensions, as follows:

BRIEF DESCRIPTION OF THE DRAWINGS

FIG. 5 is a top view of a disc designed for the top and end of a can, cut with the normally used diameter employed with conventional seaming process;

FIG. 6 is a top view of a disc designed for the top and end of a can, cut with a considerably smaller diameter, used for the micro-seaming and in accordance to the object of the new process;

FIG. 7 is a top view of an already stamped top and end of a can, according to the dimensions used for conventional seaming process;

FIG. 8 is a top view of an already stamped top and end of a can, according to the dimensions used for the new seaming process;

FIG. 9 is a sectional view of an already stamped top and end of a can, showing the profile and curling dimensions used for conventional seaming process;

FIG. 10 is a sectional view of an already stamped top and end of a can, showing the profile and reduction of curling dimensions for the new seaming process;

DETAILED DESCRIPTION

Figure 15:
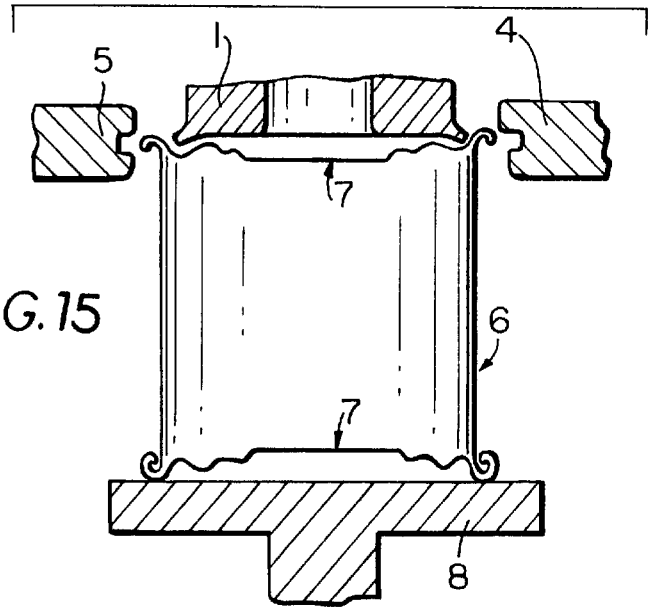
FIG. 15 is a diagram of seamer head chuck and rolls used for seaming the cans.

Describing in more detail the microseamed can and its manufacturing process consists in using seaming equipment well known in the art. Seaming operations are currently effected by using a type of machine of which the essential components are comprised of at least (FIG. 15); one or more stations for the closing machine, having a base plate 8, a seaming chuck 1, at least one first operation roll 4, and one second operation roll 5. The base plate, or can holding chuck, of the machine, supports the can body 6. The snug fitting seaming chuck holds the can cover (can end) 7 in place on the can body and acts as a back-up for the seaming roll pressure.

Figure 16:
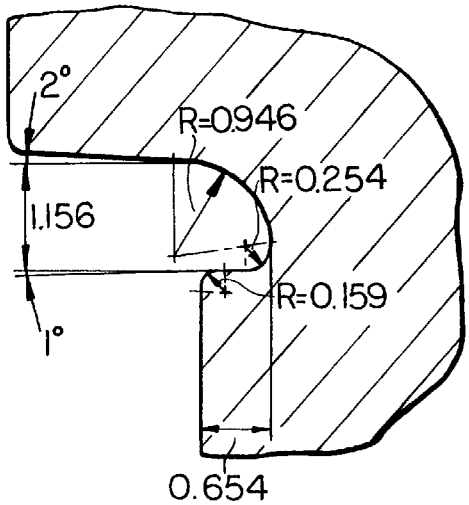
FIG. 16 shows a profile and dimensions of a first seam roll for microseam.
Figure 17:
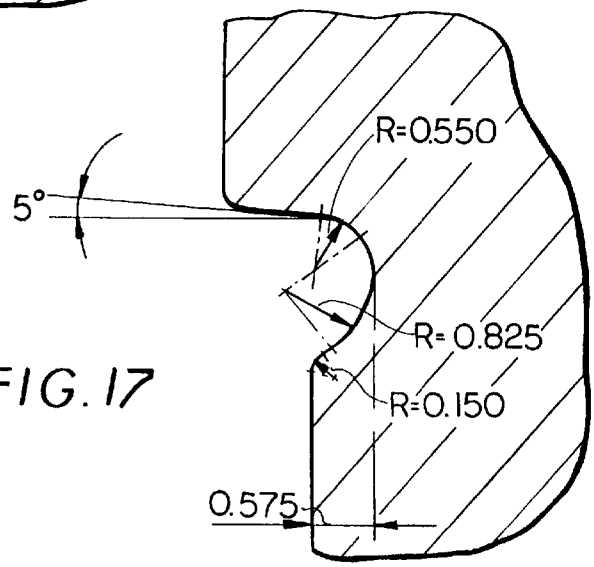
FIG. 17 shows a profile and dimensions of a second seam roll for microseam.
Figure 18:
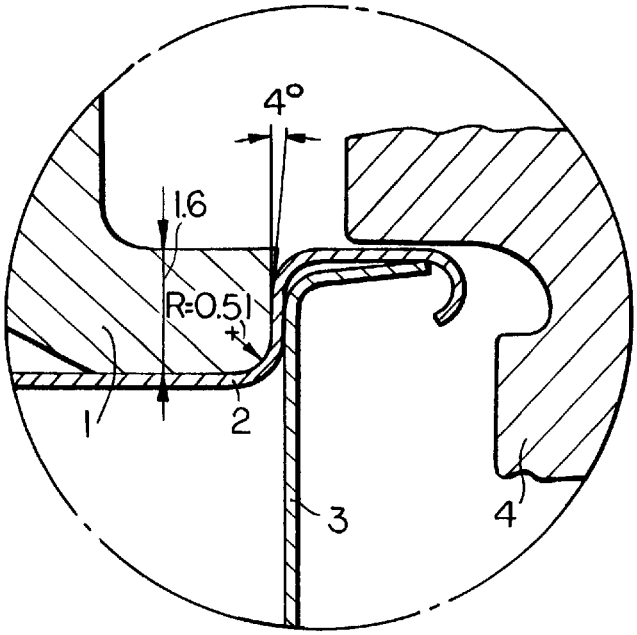
FIG. 18 is a side view of the cover or can end and the can body before the first seaming operation.
Figure 19:
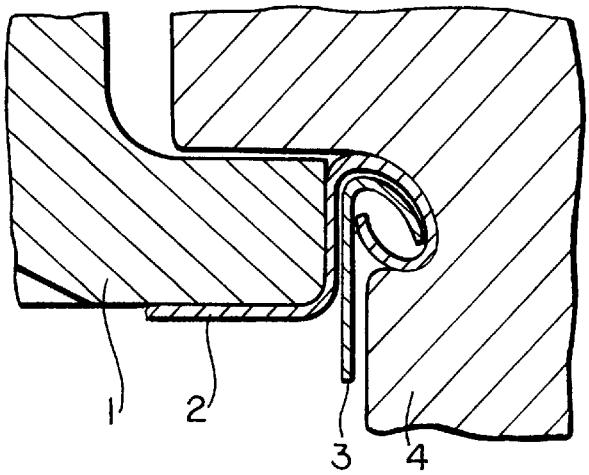
FIG. 19 is a side view of the microseam after the first seam roll operation.
Figure 20:
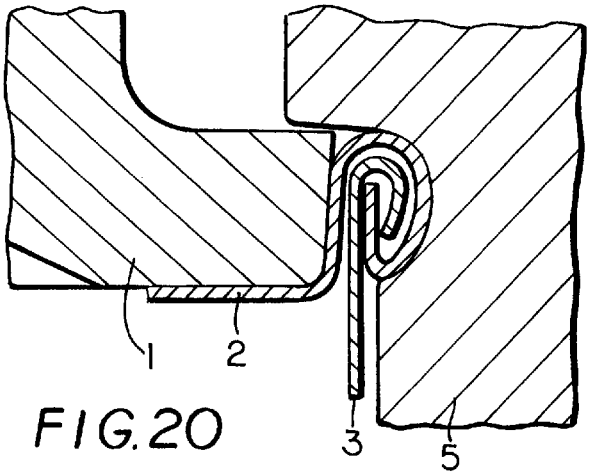
FIG. 20 is a side view of the microseam after the second seam roll operation.

The current microseaming uses seaming equipment exactly the same as the traditional seaming equipment described above, except for the redesigning and redimensioning of the first and second operation rolls (FIGS. 16 and 17).

Figure 21:
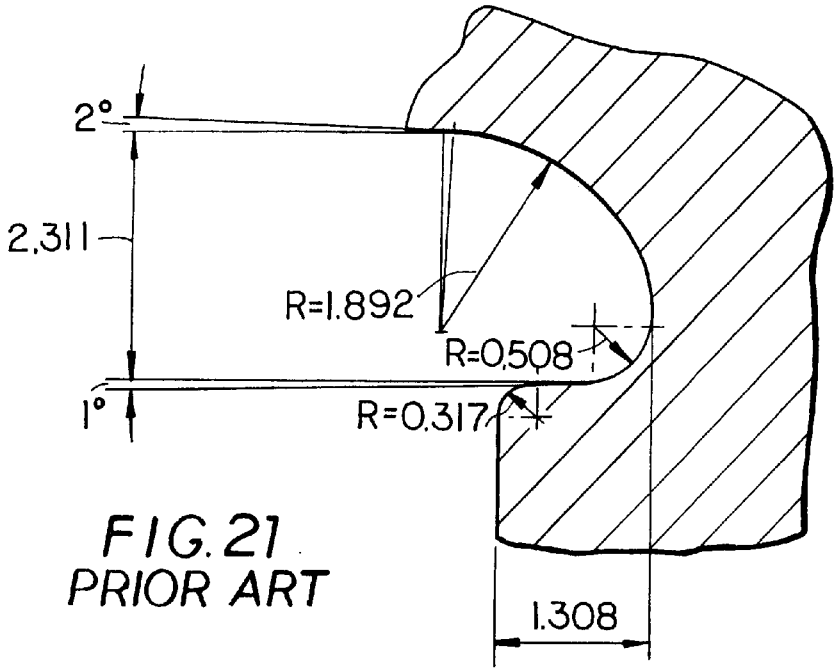
FIG. 21 PRIOR ART
FIG. 21 shows a profile and dimensions of a first seam roll for conventional seam.
Figure 22:
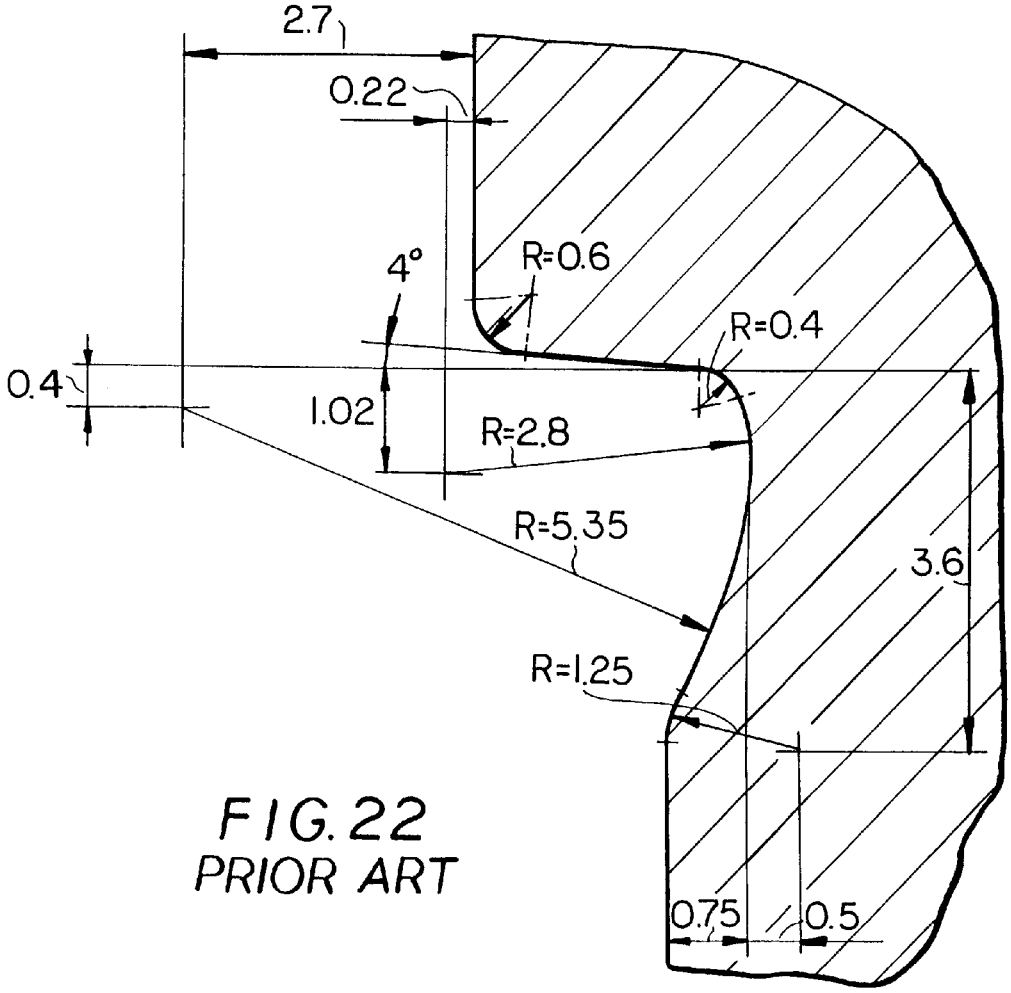
FIG. 22 PRIOR ART
FIG. 22 shows a profile and dimensions of a second seam roll for conventional seam.

The redesigning and redimensioning of the first and second operation rolls vary according to the thickness and hardness of the metallic material as well as the diameter of the can. This applies both to cans produced by microseaming and cans produced by conventional seaming. Therefore, the designs and dimensions of the first and second operation rolls shown in FIGS. 16 and 17 are valid for microseaming can ends (to bodies of cans) with 73 mm diameter produced with, for example, 0.16 mm thick material and DR8 temper. These first and second operation rolls may also be used for other metals in forming a microseam, including the more ductile metals such as aluminum. Comparatively the FIGS. 21 and 22 show the designs and dimensions of the first and second operation rolls for conventionally seaming can ends (to bodies of cans) with 73 mm diameter produced with 0.22 thick material and T61 hardness.

The above example is one illustration of microseaming. It is understood that other dimensions can be used for microseaming and the present application is not limited to this one example.

Consequently, for can ends having diameters greater or smaller than 73 mm, the measurements shown in FIGS. 16, 17, 21 and 22 (units are calibrated in mm) should be revised accordingly with reference to the above illustrated example. This applies both to conventional seaming and microseaming.

All the stages of formation of micro-seam are illustrated in FIGS. 18, 19, 20 and 2. In the first operation, FIGS. 18 and 19, the micro-curl of the end 2 is interlocked (sometimes referred to as engaged) with the micro-flange 3 of the can body of a first operation roll 4 having a specially contoured groove to be pressed against the seaming chuck 1. After the first seam operation is completed, the first operation roll is retracted and no longer contacts the can cover (can end). The second operation roll 5 (FIG. 20) has a different groove profile from that of the first operation roll. This groove is flatter than the first operation groove and is designed to press the preformed hooks together; to iron out wrinkles in the cover hook and to obtain micro-seam tightness. A good and uniform seaming is obtained with this new can manufacturing process and with special measurements in the cover hook, body hook, overlap A, length of the micro-seam and other folds (see FIG. 2).

Figure 2:
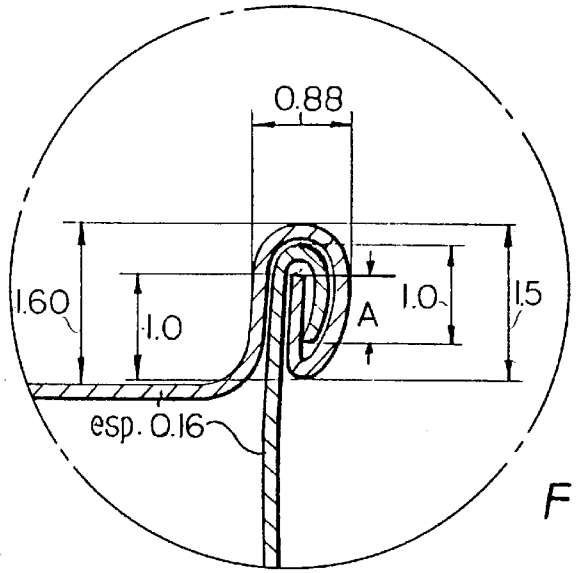
FIG. 2 is a sectional view, showing a microseam obtained by the new process, for example, by employing a metal sheet of lesser thickness, i.e. 0.16 mm and a harder one, i.e. with DR8 temper tinplate, of which the seaming dimensions are considerably reduced in comparison with the conventional process.

Referring to FIG. 2, typical dimensions of a microseam are depicted for a can having its product contents under vacuum. The microseam illustrated has a reduced length of 1.50 mm, a reduced body hook of 1.0 mm, a reduced cover hook of 1.0 mm, a reduced countersink of 1.60 mm and a seam thickness of 0.88 mm. It should be recognized that these dimensions are not absolute, but will vary with the type and thickness of materials used for the can end and the can body, as well as whether the can is intended for use as a vacuum can or for a can having an internal pressure higher than atmospheric pressure. Microseam dimensions for various compositions of cans are listed below, as examples:

| | Microseam Ranges | |
|---|---|---|
| | (in) | (mm) |
| 1. Containers: Body (steel) Ends (steel) | | |
| Seam Thickness | .034–.062 | .86–1.57 |
| Seam Height | .059–.079 | 1.50–2.00 |
| Countersink Depth | .063–.091 | 1.60–2.31 |
| 2. Containers: Body (fibre) Ends (aluminum or steel) | | |
| Seam Thickness | .044–.072 | 1.11–1.82 |
| Seam Height | .056–.073 | 1.42–1.85 |
| Countersink Depth | .063–.091 | 1.60–2.31 |
| 3. Containers: Body (plastic) Ends (aluminum or steel) For Food or non Food Products | | |
| Seam Thickness | .040–.063 | 1.01–1.60 |
| Seam Height | .059–.079 | 1.50–2.00 |
| Countersink Depth | .063–.091 | 1.60–2.31 |
| 4. Containers: Body (Plastic) Ends (aluminum or steel) For Beverage Products (soft drinks and beer) | | |
| Seam Thickness | .040–0.063 | 1.01–1.60 |
| Seam Height | .059–.079 | 1.50–2.00 |
| Countersink Depth | .235–.288 | 5.97–7.31 |
| 5. Containers: Body (aluminum or steel) Ends (aluminum or steel) For Food Products with Vacuum in the Can Inside | | |
| Seam Thickness | .044–.060 | 1.12–1.52 |
| Seam Height | .062–.076 | 1.57–1.93 |
| Countersink Depth | .063–.084 | 1.60–2.13 |
| 6. Containers: Body (aluminum or steel) Ends (aluminum or steel) For Beverage Products (soft drinks and beer) | | |
| Seam Thickness | .044–.060 | 1.12–1.52 |
| Seam Height | .062–.076 | 1.57–1.93 |
| Countersink Depth | .235–.288 | 5.97–7.31 |
| 7. Containers: Body (aluminum or steel) Ends (aluminum or steel) For Aerosol products (Food or non Food Products) | | |
| Seam Thickness | .044–.060 | 1.12–1.52 |
| Seam Height | .062–.076 | 1.57–1.93 |
| Countersink Depth | .238–.293 | 6.05–7.45 |

A substantial deviation in the countersink dimension is observed in cans for uses of high internal pressure, such as beverage cans. Such a countersink is illustrated by the broken line in FIG. 25, as 6.0 mm, although the remaining dimensions are reduced to form the microseam. The countersink dimension shown here may vary somewhat depending on the application of the can.

Figure 1:
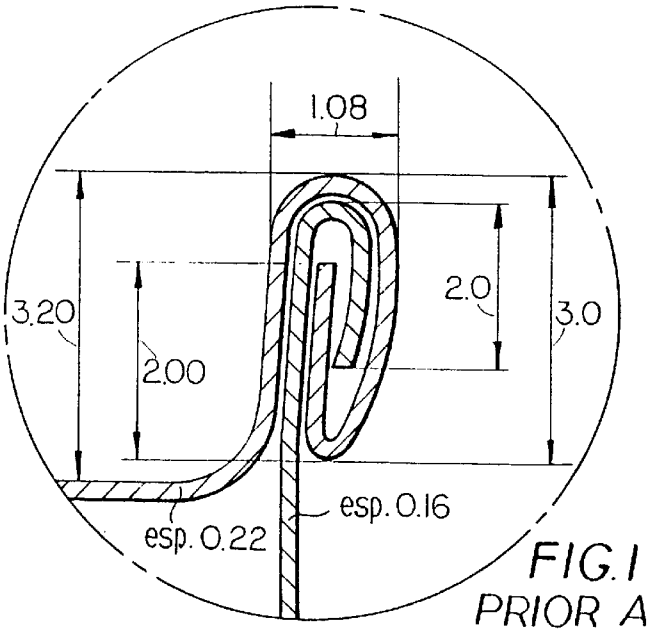
FIG. 1 PRIOR ART
FIG. 1 is a sectional view, showing the seam obtained by the conventional process, i.e., by employing a metal sheet of 0.22 mm thickness, with relatively larger seaming dimensions.
Figure 11:
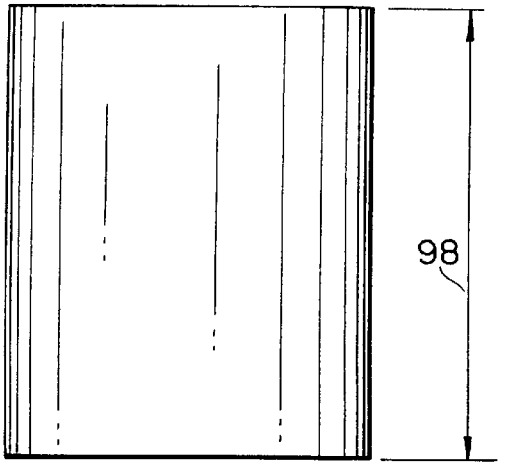
FIG. 11 PRIOR ART
FIG. 11 is a side view of a cylindrical can body with the height dimension designed for conventional seaming process.
Figure 12:
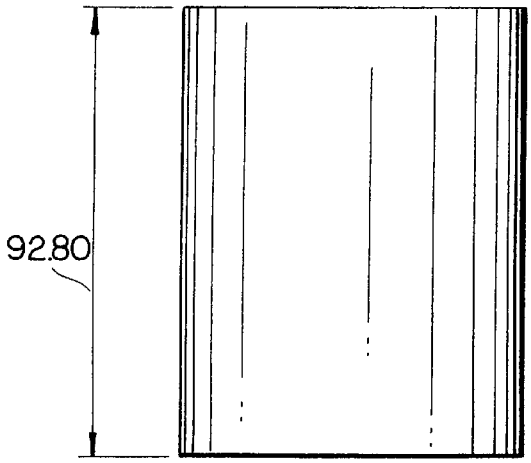
FIG. 12 is a side view of a cylindrical can body with the considerably reduced height, designed for the new microseaming process.
Figure 13:
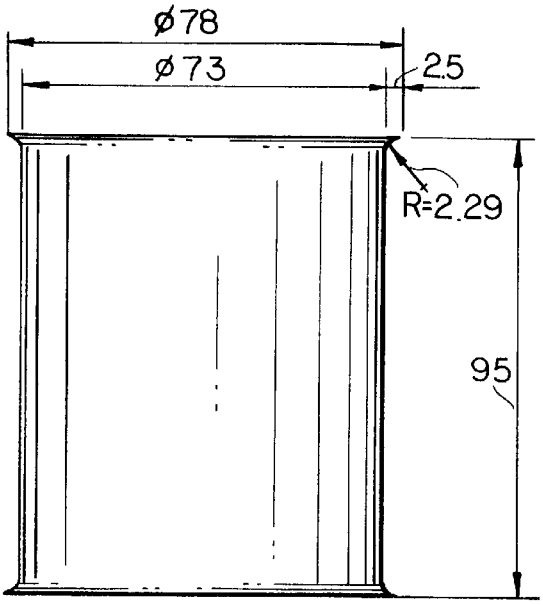
FIG. 13 PRIOR ART
FIG. 13 is a side view of a flanged can body, and its dimensions normally used for conventional seaming process.
Figure 23:
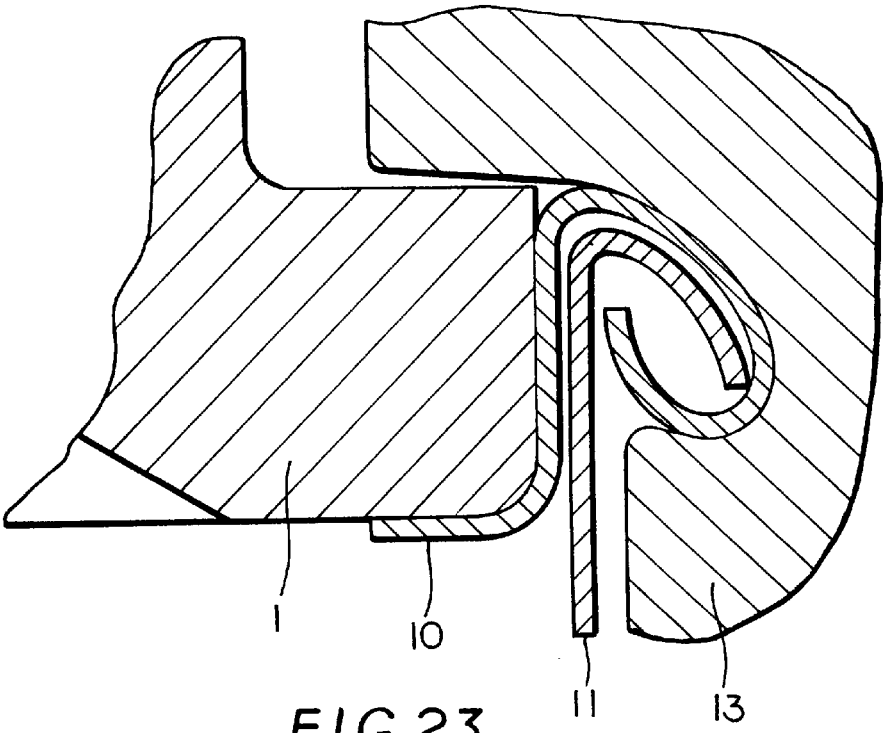
FIG. 23 PRIOR ART
FIG. 23 is a side view of the conventional seam after the first seam roll operation.
Figure 24:
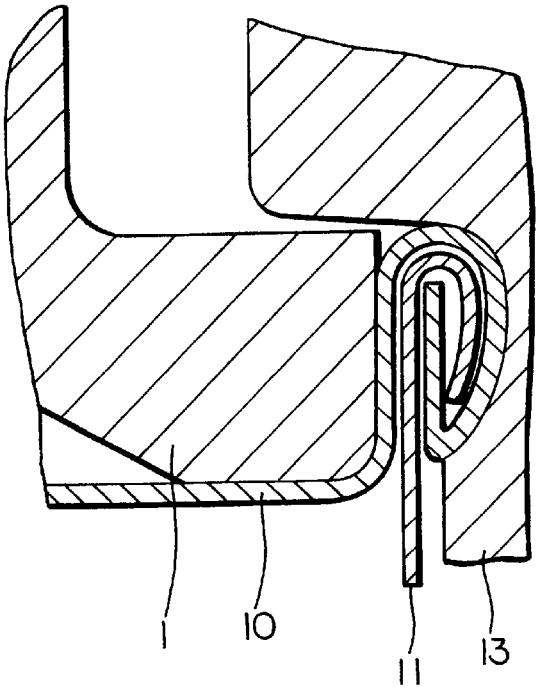
FIG. 24 PRIOR ART
FIG. 24 is a side view of the conventional seam after the second seam roll operation.

The designing of the curves and dimensioning of the first and second operation rolls for a conventional seam are shown in FIGS. 21 and 22. All the stages of formation of a conventional seam are illustrated in FIGS. 23 and 24. In the first operation, FIG. 23, the curling of the can end 10 is interlocked with the flange 11 of the can body of a first operation roll 12 having a specially contoured groove to be pressed against the seaming chuck 1. After the first seam operation is completed, the first operation roll 12 is retracted and no longer contacts the can cover (can end). The second operation roll 13 (FIG. 24) has a different groove profile from that of the first operation roll. This groove is flatter than the first operation groove and is designed to press the preformed hooks together to obtain a seam tightness with special measurements in the cover hook, body hook, length of seam and other folds (see FIG. 1).

Figure 25:
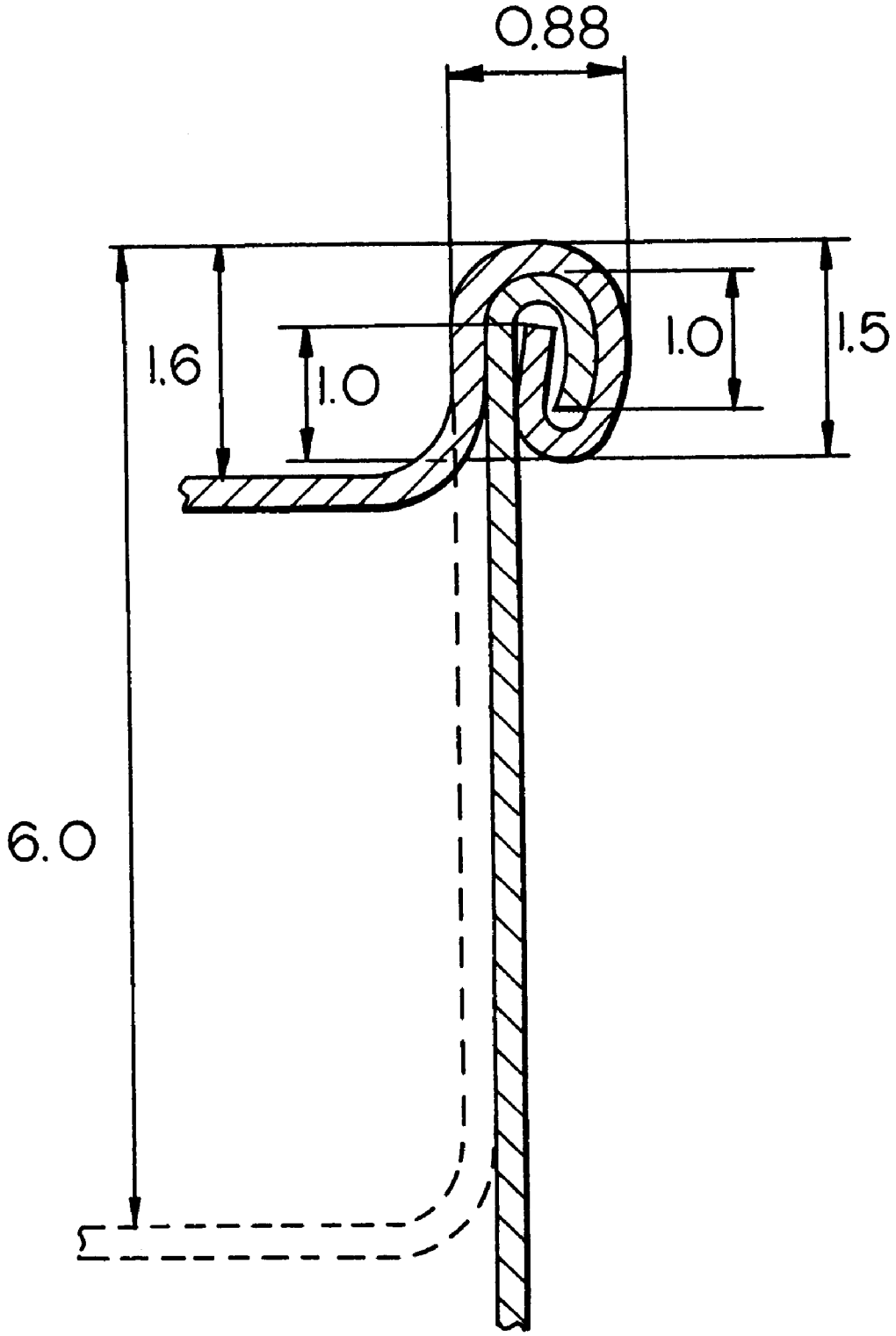
FIG. 25 is a sectional view, showing a microseam as in FIG. 2, with seaming dimensions reduced, and showing the countersink dimension as used for cans of high internal pressure.

The microseamed can of this invention may be of aluminum or steel two-piece cans to endure internal pressures higher than external pressures. In this case the same countersink dimension used for pressurized cans with a conventional seam should be maintained, as shown in FIG. 25. The remaining measures of the body hook, the end hook and the microseam height, will be the same as those in FIG. 2 or as indicated in the Examples. The dimension of the countersink is also shown for products under vacuum or in balance with the atmosphere pressure.

The microseam improvements enables one to obtain cans with substantial materials savings, due to the use of a thinner metal sheet, for example, of 0.16 mm thickness which is relatively harder, and for example with DR8 temper tinplate, thus replacing the conventionally used metal sheet for the known seaming process, what is normally employed is a metal sheet of 0.22 to 0.24 mm, which is relatively softer, and this without affecting the volumetric capacity of the cans thus obtained.

Figure 4:
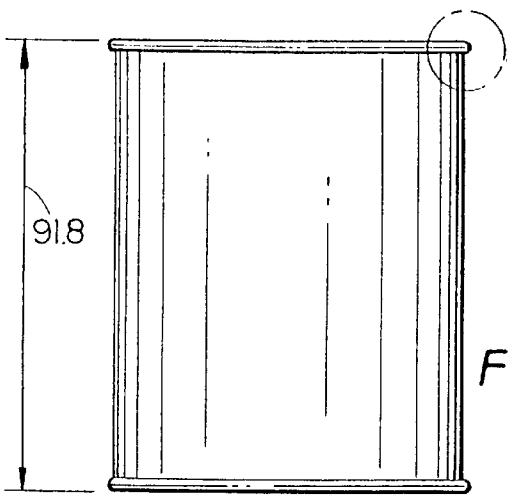
FIG. 4 is a side view of a ready or seamed can, the seam of which has been obtained by the new process, the height of its body showing to be considerably lower, without changing its volumetric capacity.
Figure 3:
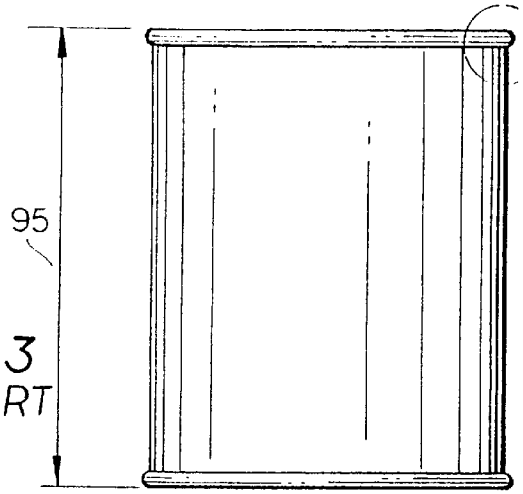
FIG. 3 PRIOR ART
FIG. 3 is a side view of a ready or seamed can with conventional seam, the height of its body being considerably greater as compared to the can obtained by the new seaming process.

This new can provides for many advantageous material savings, these savings result from the considerable reduction of the diameters of the discs which form the top and the end of a can, as shown in FIGS. 5 and 6, as well as a reduction of the hooks dimensions and other seaming dimensions, as shown in FIGS. 1–2, 9–10 and 25. In addition, more material savings result from a reduction of the height of the cylindrical body of the can, as shown on FIGS. 3 and 4 and on FIGS. 11 through 14 of the attached drawings. These reductions are obtained without affecting the volumetric capacity of the cans thus obtained through the microseaming process.

This new microseamed can may be manufactured from a variety of can making materials, although metals such as steel and aluminum are preferred. Steel is one of the preferred metals for manufacturing cans for preserves due to its great mechanical strength. Steel, or tinplate cans, therefore, are used for the majority of food products that require the products to be kept under vacuum. In such case, the steel provides the necessary mechanical strength for the packaging not to suffer a painaling, i.e., a can body wall collapse due to high vacuum, resulting in an irreversible deformation. Some examples of food products preserved under vacuum are, corn, peas, tomato products, fruit preserves, tuna fish, corned-beef, and milk products. For manufacturing of the ends of the cans, thinner and harder metal sheets are also used, such as tinplate, tin free steel-TFS (steel coated with chromium) and black plate (just steel), depending on the aggressiveness of the product. The conventional seaming processes, however, made utilization of these thinner and harder materials impossible due to problems with wrinkles formed on the end hook.

Microseamed cans may also be produced from more ductile materials, such as aluminum. There are two production processes for aluminum cans: the Draw and Redraw (D&R) and Draw and Ironing (D&I) processes.

The D&R process uniformly maintains the original aluminum thickness, both on the body fund and the body wall of the can. Aluminum cans produced by the D&R process can be used for products under vacuum.

In contrast, the D&I process only maintains the original aluminum sheet thickness on the body fund. The body wall thickness is reduced due to an ironing process, reaching thickness of about 0.10 mm in the flange area. These cans are used for products in which the internal pressure is higher than external pressure, such as carbonated beverages, like soft drinks and beer, where the internal pressure is equally and radially distributed in all points of the can body. Because these cans are extremely fragile, they can not be used for products kept under vacuum. These aluminum cans are found in two pieces only.

The aluminum used for manufacturing can bodies is generally an alloy AA3004 having an extra-hard temper H19, with thicknesses that vary from 0.30 to 0.42 mm. See The Canmaker, March 1989 issue. The following are typical mechanical properties of the aluminum, measured in rolling direction, an ultimate tensile strength 285–330N\mm$^2$ and a yield strength of 270–310N/mm$^2$. Easy-open can ends used by the two-piece cans are also produced in aluminum, but, the have a thickness of approximately 0.28 to 0.25 mm.

With aluminum cans, the countersink depth is always greater than for tinplate cans or other vacuum cans. Cans for having positive internal pressure, such as carbonated beverage or aerosol cans, use a countersink as much as twice as large as the countersink for vacuum cans. The countersink will vary according to the can diameter and height, i.e., volumetric capacity. The larger the countersink, the higher the can resistance to internal pressure.

Microseamed cans according to this invention may also be produced with non-metallic materials. Thus, composite cans and plastic cans can also be closed by the microseaming process.

In composite cans, the body is produced with different layers of Kraft paper, aluminum and polyethylene films. After the manufacturing of the body, this can be flanged according to FIG. 14. The can end and the can bottom should be produced in metallic sheet as indicated in FIGS. 6 to 10. The microseaming process will be identical to the one described in U.S. Pat. No. 5,320,468, that is, in two operations, by using the rolls profiles described. This can is also defined as a three-piece can, being normally used for dehydrated food products, such as chocolate powder, oats, milk flours, and potatoes.

Figure 14:
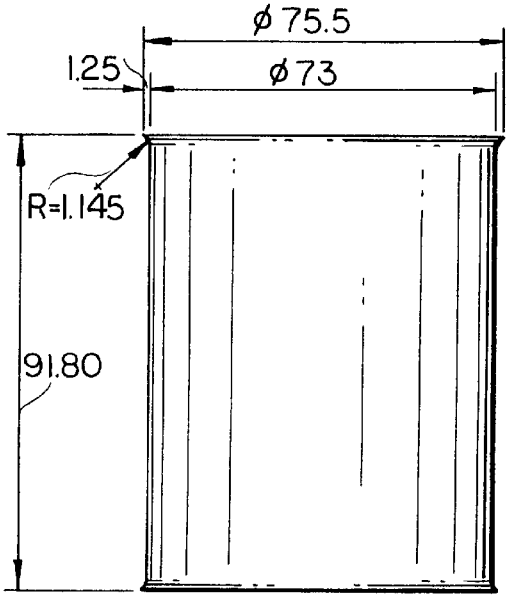
FIG. 14 is a side view of a flanged can body showing considerably reduced dimensions according to the microseaming process.

Microseaming is also applied to plastic cans, where the body is manufactured with polyester. These cans have been used for products with positive pressure, such as soft drinks and beer. Another application for these packagings has been in packing tennis balls with nitrogen ($N_2$) injection. The body can should be flanged as indicated in FIG. 14 and receives the can end produced according to FIG. 25, i.e., with the approximately 6.0 mm countersink appropriate for cans with positive pressure.

Microseamed cans may be of any can shape, cylindrical, oval, rectangular, square, or other shapes, produced with any kind of material described, as the microseaming process will be identical to the one described in U.S. Pat. No. 5,320,468.

For a perfect evaluation of the actual advantages resulting from this new can it is worthwhile to note that, in addition to this substantial materials savings, allowed by the use of a double reduced metal sheet, for example, with DR8 temper and 0.16 mm thickness in manufacturing the tops and ends of cans, the use of this lower price metal is not possible for the conventional type of seaming. The high hardness of the material and its thinness would cause the folds on the hooks to develop enormous deformations which would be transmitted into a general seaming deformation which, in addition to an extremely bad appearance of the can, leading to its technical condemnation for not providing a perfect seal and, consequently, an ideal hermetic seam, which represent the fundamental requirements for a good seaming and quality of these containers.

While the present invention has been explained in relation to its preferred embodiments, it is to be understood that various modifications thereof will be apparent to those skilled in the art upon reading this specification. The invention disclosed herein is therefore intended to cover all such modifications that fall within the scope of the appended claims.

What is claimed is:

1. A metallic can having a microseam formed between a can end and a can body providing reduction of cover hooks and body hooks as well as length of seam and overlap of seam, comprising: a flanged body of a can having a reduced flange and at least one curled can end having a reduced curl, and said curled can end having profile and curling dimensions necessary for connecting the curled can end to the reduced flange can body; said microseam having a reduced length of substantially 1.50 mm, a reduced body hook of substantially 1.0 mm, reduced cover hook of substantially 1.0 mm, and a reduced overlap and wherein the microseam is substantially free from wrinkles and folds on the cover hook and forms a hermetic seal.

2. The can according to claim 1, wherein said can end is made of metallic sheet material double reduced.

3. The can according to claim 2, wherein the double reduced material has a thickness of approximately 0.12 mm to 0.24 mm.

4. The can according to claim 1, wherein said can end is made of metallic sheet material single reduced.

5. The can according to claim 4, wherein the single reduced material has a thickness of approximately 0.18 to 0.24 mm.

6. The can according to claim 1, wherein said can body is made of metallic sheet material double reduced.

7. The can according to claim 6, wherein the double reduced material has a thickness of approximately 0.12 mm to 0.24 mm.

8. The can according to claim 1, wherein said can body is made of metallic sheet material single reduced.

9. The can according to claim 8, wherein the single reduced material has a thickness of approximately 0.18 mm to 0.24 mm.

10. The can according to claim 1, wherein said can has the same volumetric capacity volumetric capacity independent of the substantial reductions.

11. The can according to claim 1, wherein the can is made of aluminum.

12. The can according to claim 1, wherein said can body is made of kraft paper, aluminum foil and polyethylene film.

13. The can according to claim 12, wherein the can end is made of metallic sheet metal double reduced.

14. The can according to claim 1, wherein the can body is made of plastic material.

15. The can according to claim 14, wherein the can end is made of metal double reduced.

16. The can according to claim 14, wherein the can end is made of aluminum.

17. The can according to claim 1, wherein the can is in the shape of a round cylinder, an oval cylinder, a four-sided cylinder having a rectangular cross-section or a four-sided cylinder having a square cross-section.

18. A metallic can having a microseam formed between a can end and a can body providing reduction of cover hooks and body hooks as well as length of seam and overlap of seam, comprising: a flanged body of a can having a reduced flange and at least one curled can end having a reduced curl, and said curled can end having profile and curling dimensions necessary for connecting the curled can end to the reduced flange can body; said microseam having a reduced length of substantially 1.50 mm, a reduced body hook of substantially 1.0 mm, reduced cover hook of substantially 1.0 mm, a countersink of substantially 6.0 mm and a reduced overlap and wherein the microseam is substantially free from wrinkles and folds on the cover hook and forms a hermetic seal.

19. The can according to claim 18, wherein said can end is made of metallic sheet material single reduced.

20. The can according to claim 18, wherein said can body is made of metallic sheet material double reduced.

21. The can according to claim 20, wherein the double reduced material has a thickness of approximately 0.12 mm to 0.24 mm.

22. The can according to claim 18, wherein said can body is made of metallic sheet material single reduced.

23. The can according to claim 22, wherein the single reduced material has a thickness of approximately 0.18 mm to 0.24 mm.

24. The can according to claim 18, wherein the can is made of aluminum.

25. The can according to claim 18, wherein said can body is made of kraft paper, aluminum foil and polyethylene film.

26. The can according to claim 25, wherein the can end is made of metallic sheet metal double reduced.

27. The can according to claim 18, wherein the can body is made of plastic material.

28. The can according to claim 27, wherein the can end is made of metal double reduced.

29. The can according to claim 27, wherein the can end is made of aluminum.

30. The can according to claim 18, wherein the can is in the shape of a round cylinder, a four-sided cylinder having a rectangular cross-section, an oval cylinder or a four-sided cylinder having a square cross-section.

* * * * *